United States Patent [19]

Clifton

[11] Patent Number: 4,572,290

[45] Date of Patent: Feb. 25, 1986

[54] MECHANICAL SETTING TOOL

[75] Inventor: Ted G. Clifton, Tulsa, Okla.

[73] Assignee: Arrow Oil Tools Inc., Tulsa, Okla.

[21] Appl. No.: 577,144

[22] Filed: Feb. 6, 1984

[51] Int. Cl.[4] ..... E21B 23/06; E21B 23/00

[52] U.S. Cl. ..... 166/123; 166/125

[58] Field of Search ..... 166/123, 124, 125, 138, 166/139, 140, 330, 331, 210, 216

[56] References Cited

U.S. PATENT DOCUMENTS

| | | | |
|---|---|---|---|
| 3,360,049 | 12/1967 | Kisling | 166/123 |
| 3,385,366 | 5/1968 | Elliston | 166/139 X |
| 3,420,305 | 1/1969 | Alexander | 166/123 X |
| 3,497,002 | 2/1970 | Berryman | 166/123 |
| 3,705,624 | 12/1972 | Pitts | 166/140 X |
| 4,284,137 | 4/1981 | Taylor | 166/123 X |

*Primary Examiner*—Stephen J. Novosad
*Assistant Examiner*—David J. Bagnell
*Attorney, Agent, or Firm*—Steven L. Permut; Malcolm L. Sutherland; Leon E. Redman

[57] ABSTRACT

A mechanical setting tool 10 has an inner mandrel 12, an upper sleeve member 20, and a lower sleeve member 22. The inner mandrel 12 is connected through a shear stud 14 to a conventional wireline packer 16. The upper sleeve 20 has setting slips 52 therein which are set by abutting the cone 66 mounted on top of the lower sleeve 22. The lower sleeve has a bottom shoulder 78 which engages an outer sleeve of the packer 18. Upward movement of the mandrel 12 sets the slips 52 and thereafter sets the slips on the packer. The mandrel 12 then shears shear stud 14 and separates from the packer and then disengages its slips 52 so that it can be retrieved from the casing 11.

10 Claims, 15 Drawing Figures

MECHANICAL SETTING TOOL

TECHNICAL FIELD

This invention relates to a setting tool and more particularly, for a mechanical setting tool for wireline downhole tools.

DISCLOSURE INFORMATION

Wireline downhole tools have long been desirable over more conventional downhole tools in the fact that they are shorter and have less moving parts. Wireline tools such as the wireline plug have an inner sleeve with upper and lower setting slips and two inner cones. The uppers slips can be set when the inner mandrel of the wireline plug is moved upwardly relative to the upper setting slips. The upward movement of the inner mandrel also compresses the packer seals to seal against the casing. A wireline downhole tool is a relatively inexpensive part and simple to manufacture.

However, the advantages of a wireline downhole tool are often counterbalanced by the more complex and expensive method of setting the wireline downhole tool. Often an electrical wireline has to accompany the downhole tool to electrically set the downhole tools. If there is a faulty wire, the downhole tool has to be retrieved and tried again. Alternatively, hydraulic setting tools have been used to hydraulically set the downhole wireline plug. Again, this method is overly expensive due to the fact a hydraulic pressure has to be exerted by a hydraulic motor and the setting string has to be drained as it is retrieved.

What is needed is a simple mechanical setting tool that can accompany a downhole wireline plug be separated therefrom after the plug is set, and be retrieved from the casing.

SUMMARY OF THE INVENTION

According to the invention, a retrievable mechanical setting tool for setting a downhole tool in a casing includes a mandrel having a bottom end releasably connected to a first setting component of the downhole tool. Preferably, this releasable connection between the mandrel and the first setting component includes a frangible shear stud threadably connected to both the mandrel and the downhole tool. The frangible shear stud has a small diameter section which can stretch and fragment upon upward force being exerted on the mandrel.

An upper sliding member is mounted to the mandrel for axial sliding movement relative thereto. Preferably, the upper sliding member is a tubular sleeve that surrounds the mandrel and has setting slips mounted thereon.

A lower sliding member is releasably fixed to the mandrel. The lower sliding member is abuttable against a second setting component of the downhole tool. Preferably, the lower sliding member is also a tubular sleeve that surrounds the mandrel and is releasably fixed by a shear pin to the mandrel. It is also preferred that the lower member has a setting cone at the top end for abutting the setting slips mounted in the upper member.

The slips selectively engage the casing and prevent the lower and upper member from upward movement with respect to the casing once set against the casing.

A latch mechanism maintains the upper member in a relatively stable position with regard to the mandrel. The upper member preferably has a drag mechanism engageable to the casing such that upon rotation of the mandrel in one direction, the upper member frictionally lags behind the mandrel as it rotates to allow the latch means to be released allowing the mandrel to be axially lifted with respect to the upper sliding member. Upward movement of the mandrel with respect to the upper sliding member raises the lower sliding member and brings the setting cone against the slips to set the slips against the casing. Therefore, the upper member and lower member of the setting tool and the second component of the downhole tool are fixed against any upward movement. Consequently, further upward movement of the mandrel allows the first setting component of the downhole tool to move upward relative to the second setting component of the downhole tool and to set in the casing. Further upward movement of the mandrel fragments the fragmentable shear stud and releases the setting tool from the downhole tool.

A disengagement means allows the slips to disengage from the casing whereby the mandrel can be lifted and retrieved with the upper and lower sliding members.

BRIEF DESCRIPTION OF THE DRAWINGS

Reference now will be made to the accompanying drawings in which.

DETAILED DESCRIPTION OF THE PREFERRED EMBODIMENT

Figures 1A, 1B, 1C:
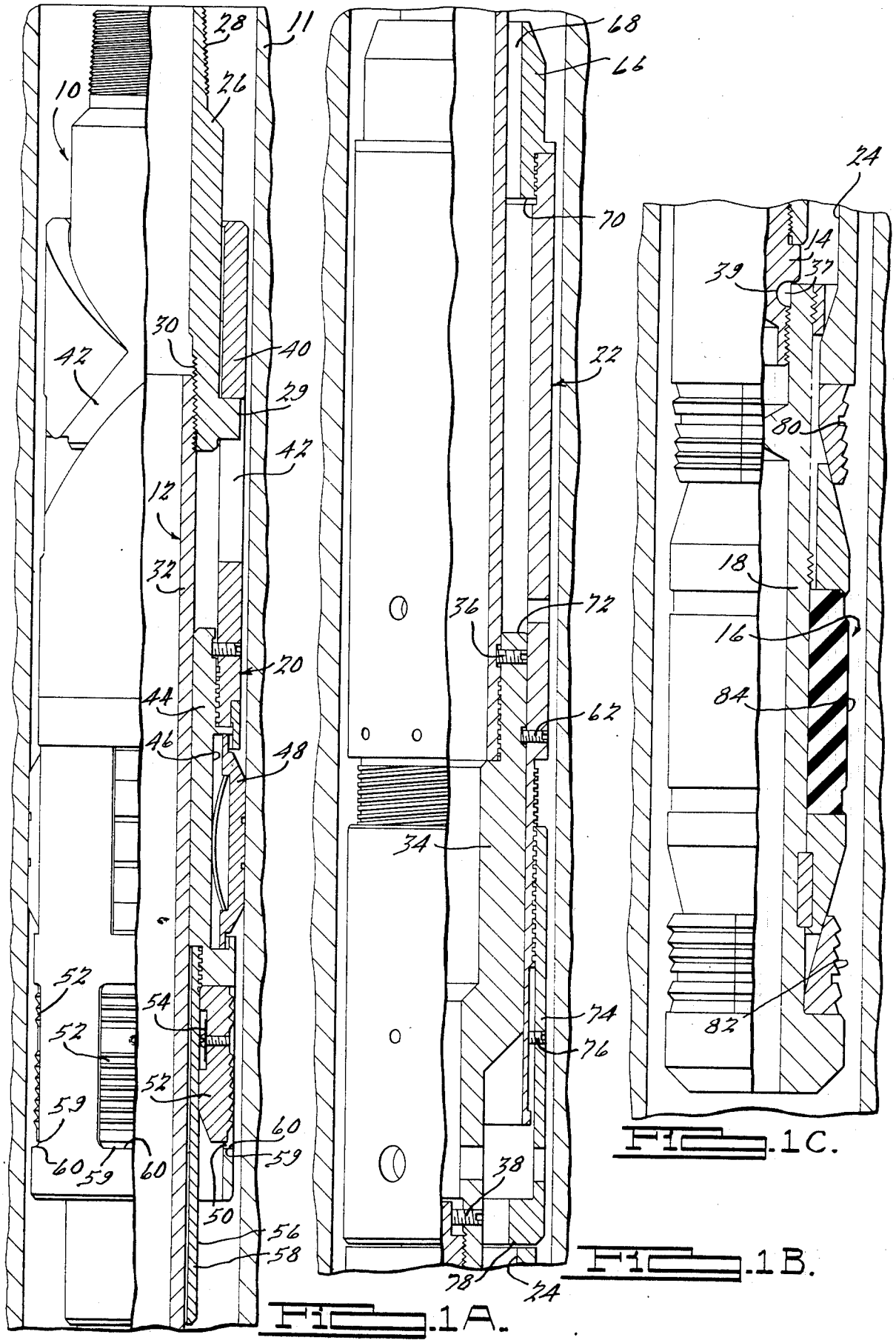
FIGS. 1A, 1B and 1C conjunctively illustrate a side elevational and partially segmented view of one embodiment of mechanical setting tool according to the invention attahed to a conventional wireline packer.

Referring to FIGS. 1A, 1B and 1C, the mechanical setting tool 10 has an inner mandrel 12 connected through a fragmentable shear stud 14 to an inner mandrel 18 of a wireline packer 16. About the inner mandrel 12 is an upper sleeve member 20 and a lower sleeve member 22 which abuts an outer sleeve 24 of packer 16.

In more detail, the inner mandrel 12 includes a latch member 26 that has a threaded upper section 28 that can be attached to a liner string (not shown). The latch member 26 has a radially outwardly extending lug 29 and an internal threaded section 30 that is attached to a tubular sleeve 32. The bottom end of the tubular sleeve 32 is threadably secured to a lower stepped sleeve 34. The shear stud 14 is threadably engaged to the lower end of the stepped sleeve 34. The shear stud 14 is also threadably engaged to the top end of inner mandrel 18 of packer 16. The shear stud has a groove 37 which forms a lesser diameter section 39 therein. In addition, set screws 36 and 38 further secure the stepped sleeve 34 to both the tubular sleeve 32 and the shear stud 14.

Referring to FIG. 1A, the upper sleeve 20 includes a J-slot component 40 that has a J-slot 42 sized to receive the lug 29. The lower end of component 40 is secured to a tubular cage member 44. The cage member 44 has a recessed groove therein that receives a spring-loaded drag sleeve 48. The drag sleeve frictionally engages the outer casing 11. The lower end of the cage member 44 has apertures 50 therethrough which house a plurality of spring-biased slips 52. The apertures 50 can have varying axial lengths such that the axial gaps 59 between the slips 52 and lower edges 60 of aperture 50 have varying dimensions. Springs 54 bias the slips 52 radially inwardly until the slips engage the outer surface 56 of a disengaging sleeve 58. The disengaging sleeve extends axially downward below slips 52 and cage member 44.

Referring to FIG. 1B, the lower sleeve 22 is releasably mounted to the stepped sleeve 34 through a series of shear pins 62. The upper member of the sleeve 22 is threadably engaged to a setting cone 66. The internal diameter of the setting cone 66 is large enough to form a gap 68 which is large enough to receive the disengaging sleeve 58. In addition, the lower portion of the setting cone 66 forms a shoulder 70 which extends radially inward such that it can engage the upper shoulder 72 of stepped sleeve 34. The axial length of the setting cone 66 is less than the amount the disengaging sleeve 56. The lower sleeve 22 has an adjustable lower extension which threadably connected thereto is fixed by a stud screw 76. The lower extension 74 has a lower shoulder 78 which abuts the outer sleeve 24 of the packer 16.

Figures 2A, 2B, 2C:
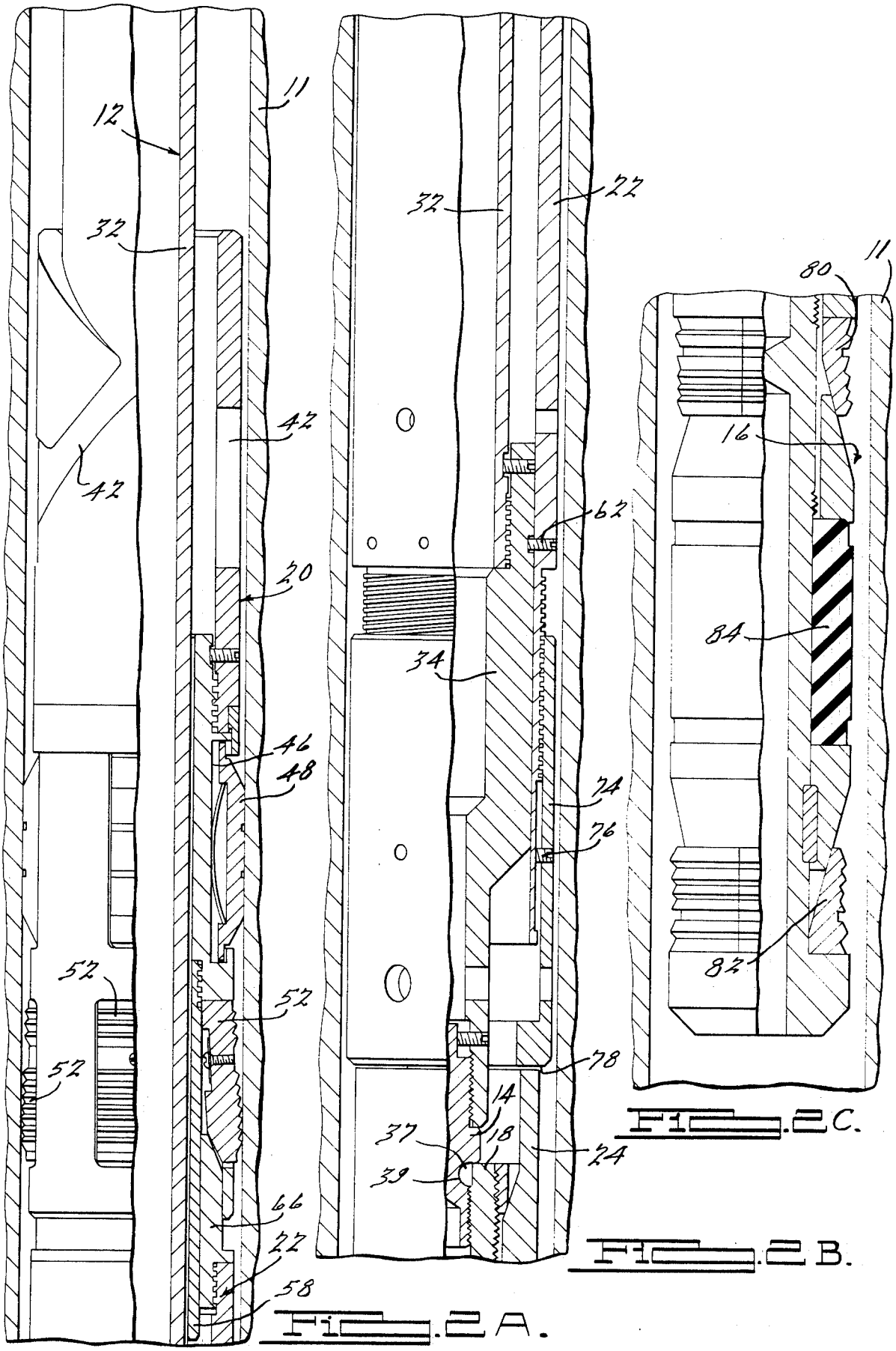
FIG. 2A, 2B and 2C conjunctively illustrate the mechanical setting tool with its inner mandrel released from the upper sliding member and raised such that the slips are set against further upward motion.

In operation, the mechanical setting tool 10 and packer 16 are lowered into the casing 11 as shown in FIGS. 1A, 1B and 1C. When the proper depth is reached, the inner mandrel 12 can be rotated such that latch 29 rotates with respect to the J-slot 42. The upper sleeve 20 drags behind the inner mandrel due to the friction exerted by drag block 48. The mandrel 12 then is free to be moved upwardly as shown in FIG. 2A, with respect to the upper sleeve member 20. Again, due to the frictional engagement of drag block 48 on the casing 11, the upper sleeve 20 drags behind the mandrel 12. The lower sleeve 22 is lifted with the inner mandrel 12 until the cone 66 abuts the slips 52 and outwardly pushes the slips 52 to engage the outer casing 11 as shown in FIG. 2A through 2C.

Figure 3A:
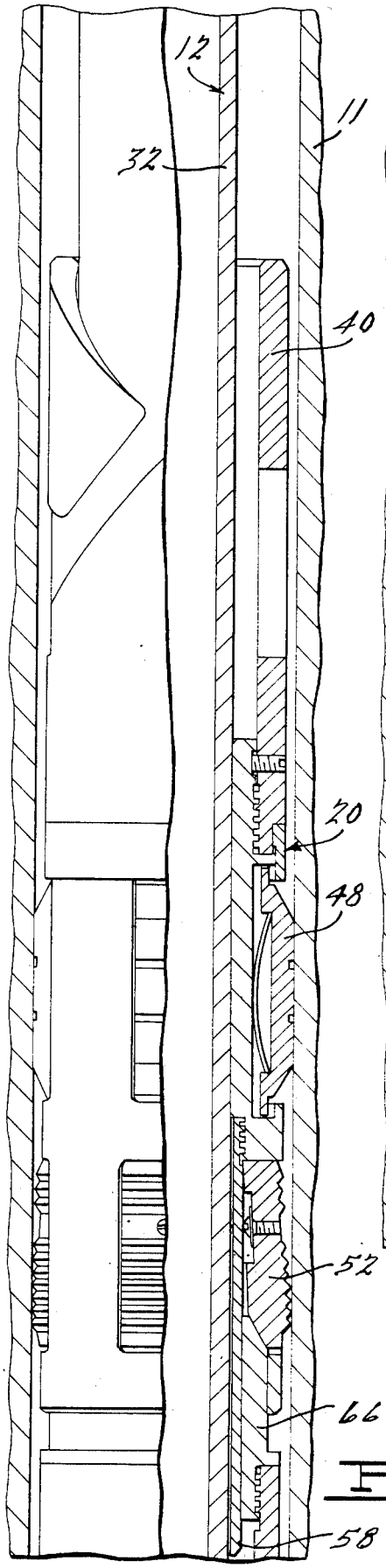
FIGS. 3A, 3B and 3C conjunctively illustrate the mechanical setting tool after fully setting the wireline packer.
Figure 3B:
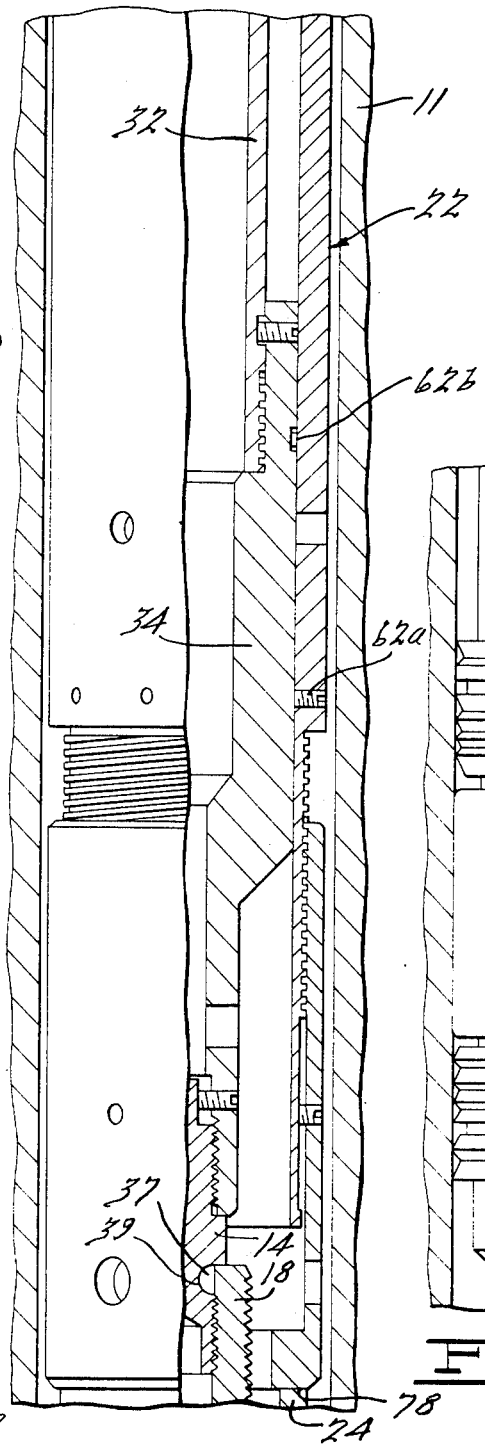
Figure 3C:
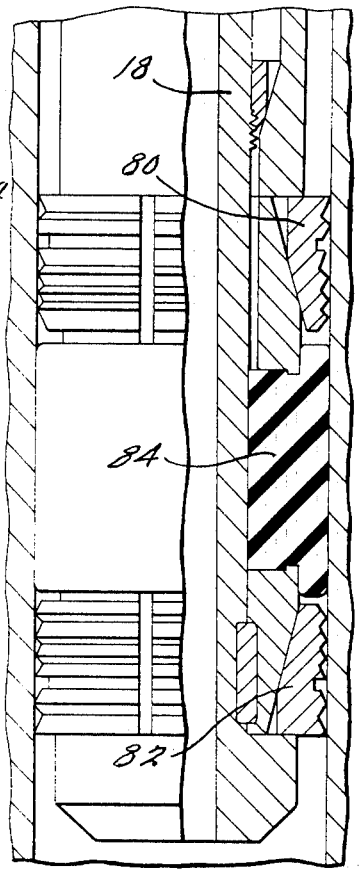
Figures 4A, 4B, 4C:
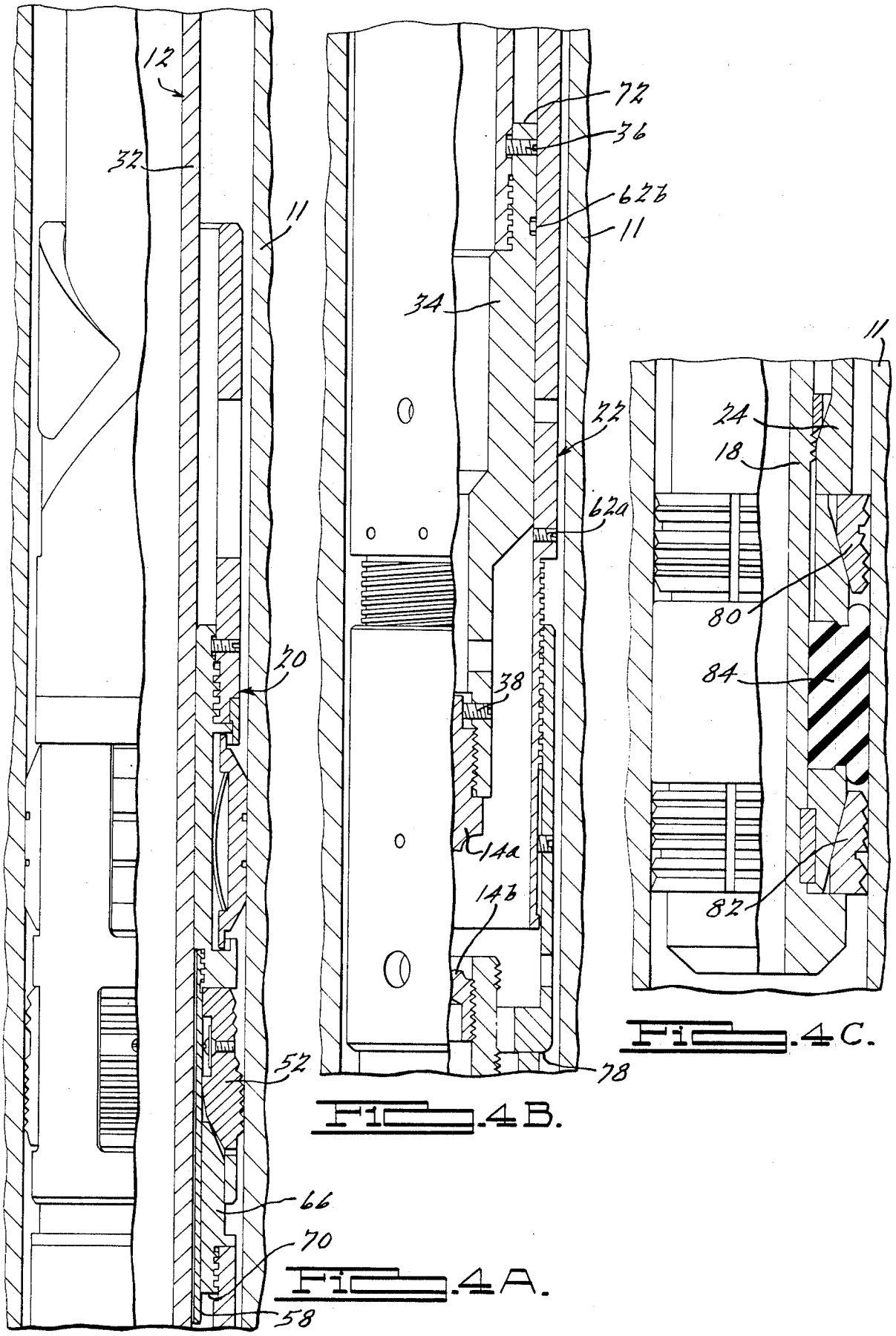
FIGS. 4A, 4B and 4C conjunctively illustrate the mechanical setting tool being released from said packer.
Figure 5A:
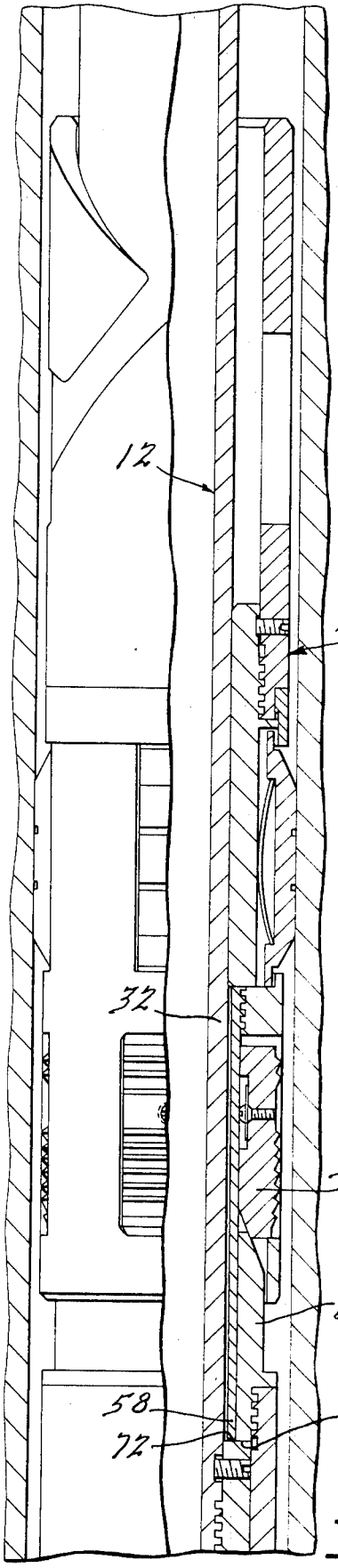
FIG. 5A, 5B and 5C show the mechanical setting tool being released from said casing and retrievable therefrom.
Figure 5B:
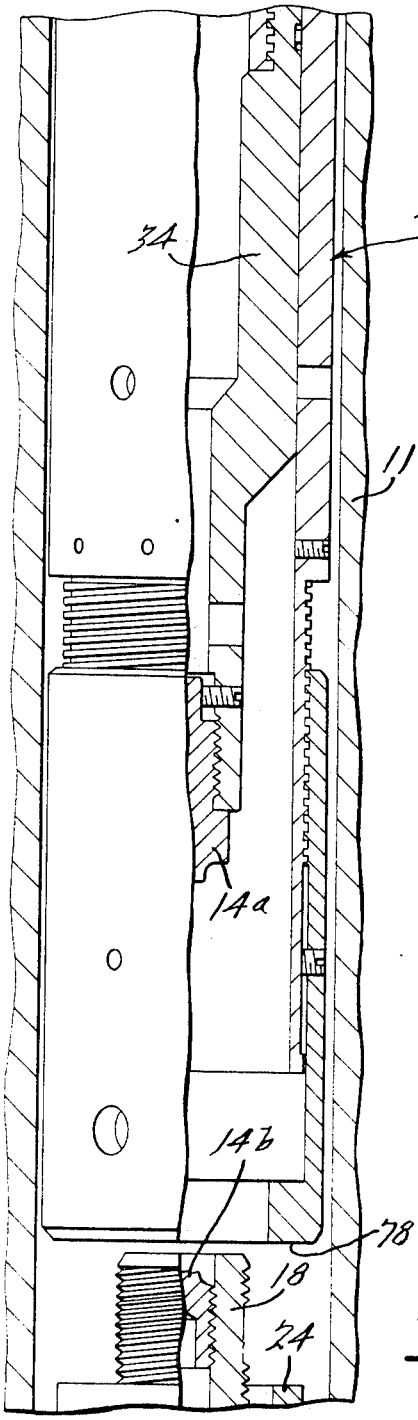
Figure 5C:
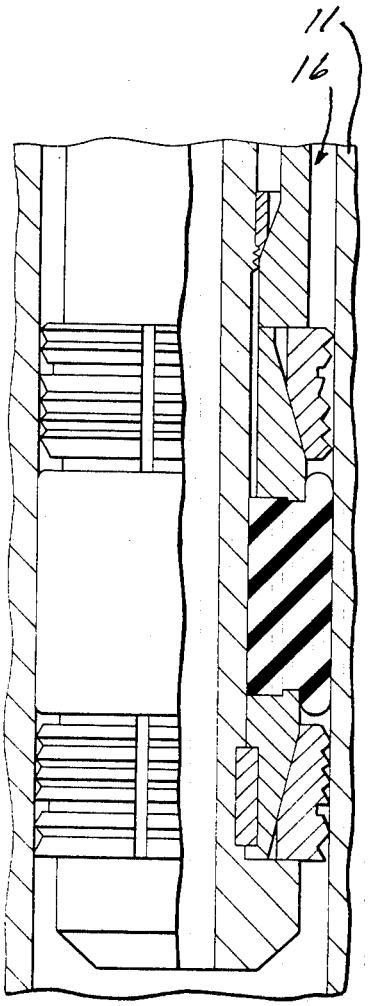

Referring now to FIGS. 3A, 3B and 3C, lower sleeve 22 no longer can move upwardly because it is stopped by slips 52. Consequently, an upward force thereafter exerted on mandrel 12 then causes shear pins 62 to shear and allow the mandrel 12 to move upwardly with respect to the sleeve 22 such that the shear stud 14 pulls the inner mandrel 18 of the packer 16 upward while the shoulder 78 of the sleeve 22 retains the outer sleeve 24 fixed such that the slips 80 and 82 start biting into the casing 11. The mandrel continues to move upwardly such that the inner mandrel 18 continues to be pulled upwardly thereby setting the slips 80 and 82 and compressing the seals 84.

After the packer 16 is fully set, further upward force exerted by mandrel 12 then stretches and shears the shear stud 14 at approximately the lesser diameter section 39. After the shear stud is sheared, further upward movement of the upper mandrel causes the shoulder 72 to abut the disengagement sleeve 58 which extends through the gap 68 of cone 66. The disengagement sleeve 58 is forced upwardly which forces the upper sleeve 20 upwardly. The bottom edges 60 of apertures 50 in cage member 44 then abut the slips 52 in a sequential fashion and sequentially release the slips 52 from the cone 66. The springs 54 radially retract the slips 52 so that they disengage from the casing 11. Further upward movement of the mandrel 12 causes shoulder 72 to abut shoulder 70 of the cone member 66. Further upward movement then provides for the entire setting tool assembly including the inner mandrel 12, upper sleeve 20 and lower sleeve 22 to be retrieved from the casing 11 with the wireline packer fully set within the casing 11.

The wireline packer is merely used as an example of any conventional wireline downhole tool. Other wireline downhole tools can be similarly set with the above-described mechanical setting tool.

Variations and modifications of the present invention are possible without departing from its spirit and scope as defined by the appended claims.

The embodiments of the invention in which an exclusive property or privilege is claimed are defined as follows:

1. A retrievable setting tool for setting a downhole tool in a casing, said setting tool comprising:

a mandrel having a bottom end releasably connectable to a first setting component of said downhole tool;

an upper sliding member mounted to said mandrel for axial sliding movement relative thereto;

a lower sliding member releasably fixed to said mandrel, said lower sliding member abuttable to a second setting component of said downhole tool;

setting means for selectively engaging said casing and preventing said lower sliding member from any upward movement with respect to said casing such that upon upward directive force directed on said mandrel after said setting means engages said casing, said mandrel becomes released from said lower sliding member and moves upwardly pulling said first setting component of said downhole tool upward relative to said second setting component which sets said downhole tool against said casing;

release means for releasing said mandrel from said first setting component of said downhole tool;

disengagement means for disengaging said setting means from said casing upon a predetermined upward movement of said mandrel with respect to said upper sliding member whereby said mechanical setting tool is free to be retrieved from said casing; and an engaging surface on said lower sliding member and a complementary engaging surface on said mandrel and said lower sliding member being abuttable for retrieving said lower sliding member as said mandrel is retrieved.

2. A setting tool as defined in claim 1 further comprising;

a latch means for maintaining said upper member in a relatively stable position with regard to said mandrel; and said upper sliding member having a drag means engageable to said casing such that upon rotation of said mandrel in one direction, said upper member frictionally lags behind said mandrel to allow said latch means to be released allowing said mandrel to be axially lifted with respect to said upper sliding member.

3. A setting tool as defined in claim 1 further comprising;

said release means comprising a frangible member affixed to both said mandrel and said first setting component of said downhole tool; and said frangible member being frangible upon an upward force exerted by said mandrel greater than the force needed to set said downhole tool.

4. A setting tool as defined in claim 3 wherein:

said frangible member is threadably connected to both said mandrel and said downhole tool and has a small diameter section which fragments upon said upward force being exerted thereon by said mandrel.

5. A retrievable setting tool for setting a downhole tool in a casing, said setting tool comprising:

a mandrel having a bottom end releasably connectable to a first setting component of said downhole tool;

an upper sliding member mounted to said mandrel for axial sliding movement relative thereto;

a lower sliding member releasably fixed to said mandrel, said lower sliding member abuttable to a second setting component of said downhole tool;

setting means for selectively engaging said casing and preventing said lower sliding member from any upward movement with respect to said casing such that upon upward directive force directed on said mandrel after said setting means engages said casing, said mandrel becomes released from said lower sliding member and moves upwardly pulling said first setting component of said downhole tool upward relative to said second setting component which sets said downhole tool against said casing;

release means for releasing said mandrel from said first setting component of said downhole tool;

disengagement means for disengaging said setting means from said casing upon a predetermined upward movement of said mandrel with respect to said upper sliding member whereby said mechanical setting tool is free to be retrieved from said casing;

an engaging surface on said lower sliding member and a complementary engaging surface on said mandrel and said lower sliding member being abuttable for retrieving said lower sliding member as said mandrel is retrieved;

a lower extension on said upper sliding member telescoped with said lower sliding member when said setting means is set; and an engaging radial shoulder on said mandrel normally axially spaced from a said lower extension and engageable therewith only after said mandrel is moved upwardly a distance sufficient for said release means to release said mandrel from said downhole tool.

6. A setting tool as defined in claim 5 wherein:

said engaging radial shoulder on said mandrel being said complementary engaging surface on said mandrel that engages said surface on said lower sliding member for retrieving said lower sliding member.

7. A setting tool as defined in claim 6 further comprising;

a latch means for maintaining said upper member in a relatively stable position with regard to said mandrel; and said upper sliding member having a drag means engageable to said casing such that upon rotation of said mandrel in one direction, said upper member frictionally lags behind said mandrel to allow said latch means to be released allowing said mandrel to be axially lifted with respect to said upper sliding member.

8. A setting tool as defined in claim 6 further comprising;

said release means comprising a frangible member affixed to both said mandrel and said first setting component of said downhole tool; and said frangible member being frangible upon an upward force exerted by said mandrel greater than the force needed to set downhole tool.

9. A setting tool as defined in claim 8 wherein:

said frangible member is threadably connected to both said mandrel and said downhole tool and has a small diameter section which fragments upon said upward force being exerted thereon by said mandrel.

10. A retrievable mechanical setting tool for setting downhole tools in a casing, said setting tool comprising:

an inner mandrel having a bottom end connectable to an inner component of said downhole tool;

an outer upper tubular member surrounding said inner mandrel and axially slideable thereon;

an outer lower tubular member surrounding said inner mandrel and releasably fixed thereto, said outer lower tubular member aubuttable against an outer component of said downhole tool;

setting means for affixing said outer members with respect to said casing against upward movement, such that upon further upward movement of said inner mandrel, said inner mandrel becomes released from said outer lower tubular member and moves upward relative to said outer lower tubular member causing said outer component to move relative to said inner component of said downhole tool with such relative movement causing said downhole tool to set and affix against said casing;

release means for releasing said inner mandrel from said inner component;

disengagement means for disengaging said setting means from said casing upon a predetermined upward movement of said inner mandrel with respect to said outer upper tubular member whereby said mechanical setting tool can be retrieved from said casing.

* * * * *